US007258530B2

(12) United States Patent
Morrison et al.

(10) Patent No.: US 7,258,530 B2
(45) Date of Patent: Aug. 21, 2007

(54) CMC COMPONENT AND METHOD OF FABRICATION

(75) Inventors: Jay A. Morrison, Oviedo, FL (US); Gary B. Merrill, Orlando, FL (US); Steven James Vance, Orlando, FL (US); Harry A. Albrecht, Hobe Sound, FL (US); Yevgeniy Shteyman, West Palm Beach, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 211 days.

(21) Appl. No.: 11/040,464

(22) Filed: Jan. 21, 2005

(65) Prior Publication Data

US 2007/0128043 A1 Jun. 7, 2007

(51) Int. Cl.
*F01D 5/14* (2006.01)

(52) U.S. Cl. ..... 416/232; 416/241 B; 29/889.71; 29/889.72

(58) Field of Classification Search ..... 416/232, 416/229 R, 229 A, 227 R, 241 B; 29/889.71, 29/889.72; 264/257, 259, 261, 265, 267
See application file for complete search history.

(56) References Cited

U.S. PATENT DOCUMENTS 5,601,674 A * 2/1997 Szweda et al. ..... 156/89.11
6,013,592 A 1/2000 Merrill et al.
6,197,424 B1 3/2001 Morrison et al.
6,287,511 B1 9/2001 Merrill et al.
6,617,013 B2 9/2003 Morrison et al.
6,648,597 B1 11/2003 Widrig et al.
6,676,783 B1 1/2004 Merrill et al.
6,709,230 B2 3/2004 Morrison et al.
6,733,907 B2 5/2004 Morrison et al.
6,758,653 B2 7/2004 Morrison
6,767,659 B1 7/2004 Campbell
7,093,359 B2 * 8/2006 Morrison et al. ..... 29/889.71
2003/0035907 A1 2/2003 Campbell et al.
2004/0028941 A1 2/2004 Lane et al.
2004/0058201 A1 3/2004 Merrill et al.

* cited by examiner

*Primary Examiner*—Ninh H. Nguyen

(57) ABSTRACT

An airfoil (44) formed of a plurality of pre-fired structural CMC panels (46, 48, 50, 52). Each panel is formed to have an open shape having opposed ends (54) that are free to move during the drying, curing and/or firing of the CMC material in order to minimize interlaminar stresses caused by anisotropic sintering shrinkage. The panels are at least partially pre-shrunk prior to being joined together to form the desired structure, such as an airfoil (42) for a gas turbine engine. The panels may be joined together using a backing member (30), using flanged ends (54) and a clamp (56), and/or with a bond material (36), for example.

14 Claims, 2 Drawing Sheets

CMC COMPONENT AND METHOD OF FABRICATION

FIELD OF THE INVENTION

This invention relates generally to ceramic matrix composite (CMC) materials formed as structural members, and more specifically to CMC airfoil members as may be used in a gas turbine engine.

BACKGROUND OF THE INVENTION

Ceramic materials are often used in high temperature applications such as the hot combustion gas path components of a gas turbine engine. Monolithic ceramic materials generally exhibit higher operating temperature limits than do metals, however they lack the toughness and tensile load carrying capabilities required for most structural applications. Ceramic matrix composite (CMC) materials are known to provide a combination of high temperature capability, strength and toughness.

FIG. 1 is a cross-sectional view of a prior art component, specifically a stationary airfoil or vane 10 for a gas turbine engine that is formed using ceramic materials. Vane 10 includes a layer of a very high temperature ceramic insulating material 12 disposed over a CMC structural member 14, such as is described in U.S. Pat. No. 6,197,424, incorporated by reference herein in its entirety. The CMC structural member 14 defines a plurality of passages 16 for directing a flow of cooling air. Internal ribs or spars 18 are formed to stiffen the structure. One or both radial ends of the airfoil 10 may be supported in a platform (not illustrated) of a gas turbine engine. A layer of adhesive 20 may be used to join the insulating material 12 to the CMC structural member 14. The CMC structural member 14 may typically be formed by laying up a plurality of plies of material in stacked planes that are parallel to the exterior surface of the member 14. A predetermined number of such plies of material are used to achieve a desired thickness dimension (perpendicular to the exterior surface) in the CMC structural member 14. The plies of material are thus wrapped around the leading edge portion 22 of the airfoil 10. Interlaminar stresses between adjacent plies can result from internal pressure in the cooling air passages 16, from thermal gradients across the CMC material, and from operating loads imposed on the airfoil 10.

DETAILED DESCRIPTION OF THE INVENTION

Figure 1:
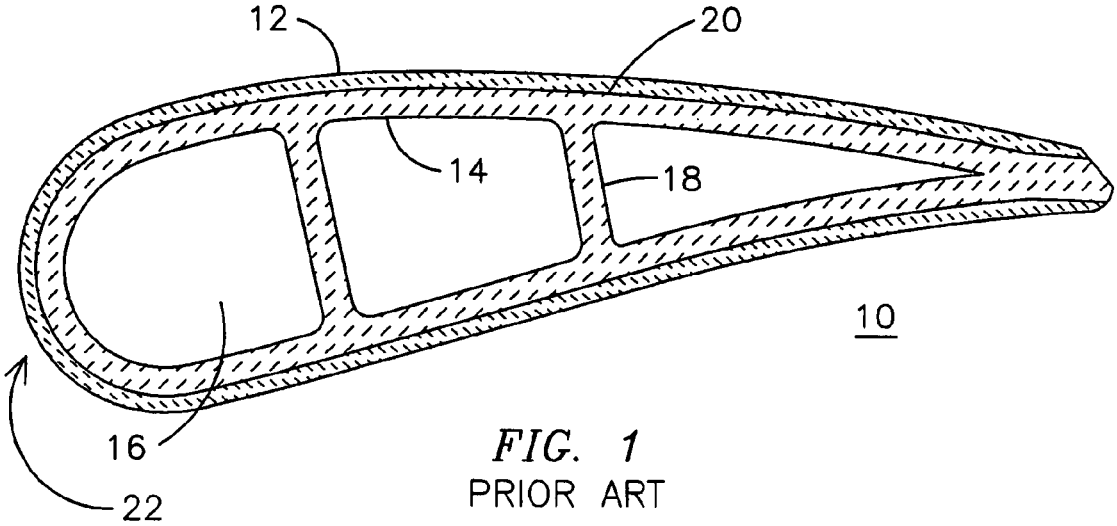
FIG. 1 PRIOR ART
FIG. 1 is a cross-sectional view of a prior art airfoil having a layer of ceramic insulation disposed over a CMC structural member.

Interlaminar cracks are known to occur between plies of the CMC material used to form the leading edge portion 22 of structures such as shown in FIG. 1 during the fabrication of such structures. Interlaminar cracks are deleterious to the performance of the CMC airfoil 10 from a variety of perspectives. First, delamination across the thickness of the CMC structural member 14 results in a decrease in thermal conductivity, thereby reducing the effectiveness of the cooling air flowing through passages 16. Second, small interlaminar cracks formed during fabrication may be susceptible to crack propagation during operation due to the interlaminar stresses created by thermal gradients through the thickness of the CMC material. Third, delaminated CMC material will cause the vane 10 to become susceptible to vibration damage and spallation of the overlying insulating material 12. Fourth, delamination will result in a reduction in load-carrying capability of the CMC wall under bending loads.

The CMC structural member 14 may be formed by laying up a plurality of wet plies of woven ceramic material, either in the form of pre-preg material or as dry material that is later infused with wet matrix material, in order to obtain a desired thickness. As the material is dried, cured and/or fired it will shrink. Monolithic ceramics exhibit isotropic shrinkage. The shrinkage of CMC materials is not isotropic, since in-plane shrinkage is dominated by the fiber properties whereas thru-thickness shrinkage is dominated by matrix properties. In some embodiments of oxide—oxide CMC materials, the percentage of thru-thickness shrinkage may be an order of magnitude larger than the percentage of in-plane shrinkage (e.g. 5% verses 0.5%). The present inventors have found that this anisotropic shrinkage can cause interlaminar stress and possible interlaminar failure of structures such as the prior art CMC structural member 14 of FIG. 1. Specifically, the present inventors have discovered that CMC structures that are constrained by a closed geometry may develop unacceptably high interlaminar strains during curing, especially in regions of tight curvature such as the leading edge portion 22 of airfoil 10 and other regions where through-thickness shrinkage cannot be accommodated. Such strains may result in the formation of either undesirable voids or cracks during any process that causes shrinkage. Such processes, su include and are variously known in the trade as drying, curing, firing, sintering, transforming, pyrolyzing, chemically cross-linking, etc.

Figure 2A:
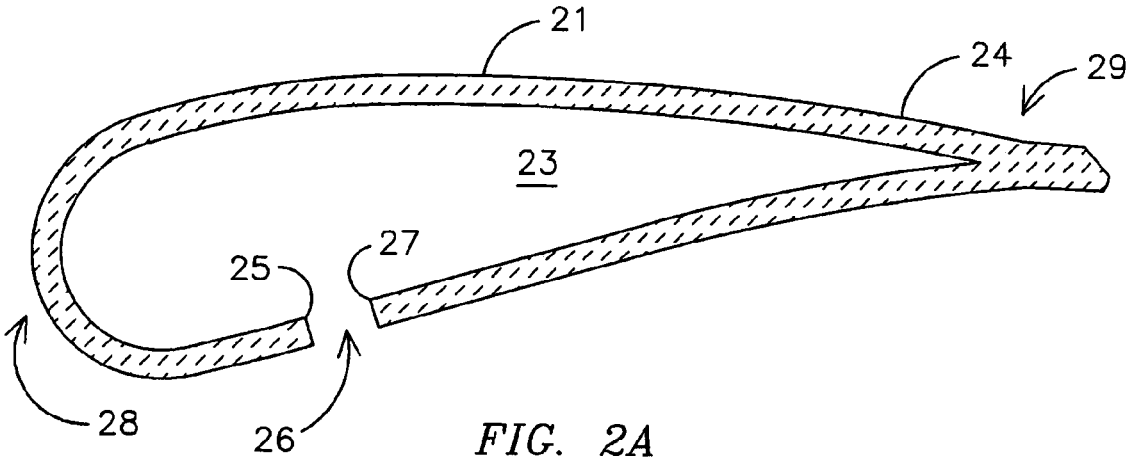
FIG. 2A is a cross-sectional view of an open CMC structural member in the shape of an airfoil containing a gap.
Figure 2B:
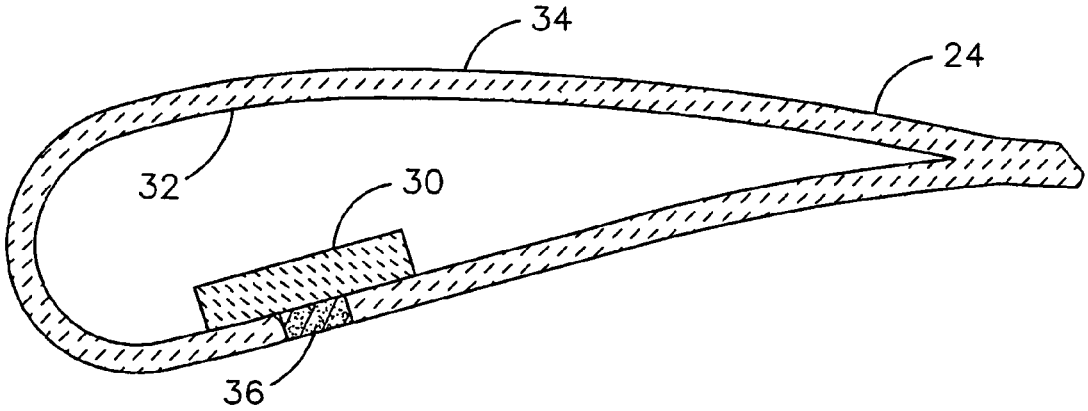
FIG. 2B is the CMC structural member of FIG. 2A with the gap sealed after a firing operation.
Figure 2C:
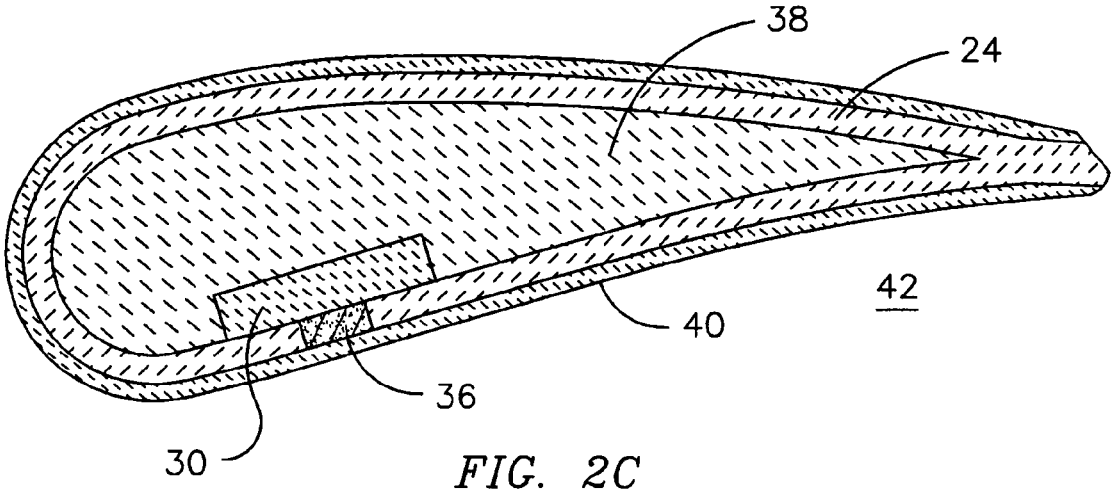
FIG. 2C is the CMC structural member of FIG. 2B with a ceramic core and a layer of ceramic insulation applied.

FIGS. 2A, 2B and 2C illustrate steps in a method of fabrication of a CMC airfoil assembly that mitigates the interlaminar cracking problem. FIG. 2A illustrates a cross-sectional view of an open CMC structural member 24 in the shape of an airfoil defining a desired exterior surface shape 21 and a core region 23. The terms closed member and open member are used herein to differentiate between structures that are and are not self-constrained against shrinkage movement as a result of the shape of the structure itself. An open structure is one wherein every cross-section reveals at least one opening, such as gap 26 in FIG. 2A between an exterior surface 21 and a core region 23 that allows opposed end portions 25, 27 of the member to move relative to each other so that the structure remains geometrically unrestrained against shrinkage. A closed structure is one wherein at least one cross-section reveals no such opening or gap, such as the airfoil 10 of FIG. 1. In the embodiment of FIG. 2A, the gap 26 is on the suction side of the airfoil, although in other embodiments it may be placed at any location of the airfoil including directly at the leading edge 28 or trailing edge 29.

The gap 26 will minimize any geometric constraint of the structure during any process that produces shrinkage. One or more gaps may be formed at locations where they function to allow movement in order to minimize interlaminar stresses during sintering. The airfoil member 24 is laid up and at least partially fired as an open member as illustrated in FIG. 2A. Relative movement of the opposed end portions 25, 27 accommodates anisotropic shrinkage of the CMC material so that the resultant interlaminar stresses are minimized. The gap 26 is then closed, such as by a joining member such as bonding material 36 and/or a ceramic backing member 30 applied to an internal surface 32 and as illustrated in FIG. 2B. In other embodiments a backing member may be applied to the external surface 21 of the structural airfoil member 24. The location of the gap(s) may be selected taking into account the mechanism of gap closure and the strength of the structure in the region of the closed gap; i.e. a gap may be formed in a region of the component that is subjected to relatively lower loads during operation of the component, for example. Finally, a ceramic core 38 may be cast to at least partially fill the central core region 23 of the structural airfoil member 24, and/or a layer of ceramic insulating material 40 may be applied. The completed airfoil assembly 42 is then finished fired to develop the full strength of the CMC material and bonds. One may appreciate that other combinations of these structures may be used to close the open structure after the initial firing process; e.g. using either the core material 38 or the insulating layer material 40 to fill the gap 26; using various radial lengths of the backing member 30; using adhesive with or without a backing member 30 to close the gap; etc.

Figure 3:
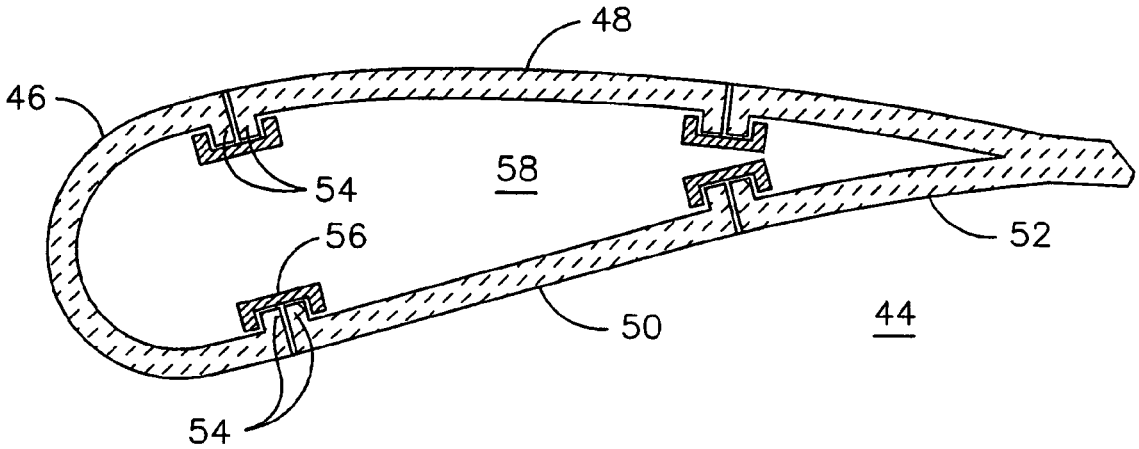
FIG. 3 is a cross-sectional view of an airfoil formed by joining together a plurality of pre-fired open CMC structural panels.

FIG. 3 illustrates another embodiment of a CMC airfoil assembly 44 having a structure and fabricated by a process that minimizes interlaminar stress during firing. Airfoil 44 if fabricated from four separate structural CMC panels; a leading edge panel 46 having an open generally C-shape, a suction side panel 48, a pressure side panel 50 and a trailing edge panel 52 having an open generally V-shape. The term structural CMC panel is used herein to include shapes formed of CMC material that are used as primary load-bearing members of a component; for example, in the embodiment of FIG. 3 where there is no metal load-bearing member and the CMC panels bear the operating loads for the airfoil. Each of these panels 46, 48, 50, 52 is individually an open panel, i.e. it is geometrically unrestrained by its inherent shape so that opposed portions of the panel are free to move relative to each other to relieve interlaminar stresses developed as a result of anisotropic shrinkage during firing. Each panel 46, 48, 50, 52 is individually formed and at least partially fired to a desired degree prior to being joined with its respective mating panels to form the airfoil shape as illustrated in FIG. 3. For embodiments where the airfoil is mated to an end panel or platform, the panels would be fired prior to being joined to a platform member that may constrain movement of the panel during sintering. The minimal geometric restraint generated by the respective open geometries during the sintering process allows the respective panels to be fired without causing interlaminar failure. After firing, the panels may be jointed by a variety of mechanisms. In the embodiments of FIG. 3, each panel is formed to have a flange 54 on each opposed open end, with the panels being joined by abutting and attaching the flanged end of one panel against the flanged end of the adjacent panel. In this embodiment, clamps 56 are used to hold the abutted flanged ends together. The clamps may be fabricated of any compatible material such as metal or a CMC material. A CMC clamp may be co-fired with a subsequently cast core material (not shown). The resulting closed airfoil 44 is thus formed of a plurality of separately fired and subsequently joined open load-bearing CMC structural members in a manner that eliminates the prior art problem of interlaminar cracks cause by anisotropic sintering. In this embodiment, the combination of panels 48, 50, 52 function together as a joining member to interconnect the opposed flanged ends 54 of open leading edge panel member 46 to carry a load there between; and conversely, panels 46, 48, 50 function together as a joining member to interconnect the opposed ends of open trailing edge member 52.

In a further aspect, one or more of the individual panels 46, 48, 50, 52 may be preloaded prior to being jointed to its adjoining panels. Such preload may stress the panel(s) in a direction opposed to an operating load, thereby serving to reduce an expected operating stress level. For example, when airfoil 44 is assembled, CMC structural panel 46 may be purposefully pre-loaded in a manner that pulls its two opposed flanged ends apart, thereby creating a pre-load in the panel 46 tending to pull the two flanged ends together. Internal pressure loads generated by a flow of cooling air passing through the core region 58 during operation of the airfoil 44 will stress the panel 46 in a direction opposed to the pre-load, thus resulting in a reduced net stress level in CMC structural panel 46 when compared to an embodiment where no pre-load is applied. The distance from the gap 26 to an area of peak stress, such as the leading edge 28, may be chosen to control the moment arm of the preload, since the amount of preload is a function of distance and displacement. A larger moment arm will facilitate a more precise control of the amount of preload. For laminated CMC's the through-thickness compressive strength is many times higher than the tensile strength. Thus, much room exists for interlmainar compressive preloading. In a specific embodiment, a CMC having an interlaminar tensile strength of 6 MPa has a corresponding compression strength of 250 MPa. In a specific airfoil application, interlaminar tensile stresses of 10 MPa are predicted at the leading edge due to a combination of thermal gradients and internal pressure. By preloading the CMC in the manner described to an initial stress of 10 MPa in compression, the operating stresses become zero and the CMC compressive strength limit is not approached.

Any variety of structures and methods may be used to join the individual CMC structural panels together to form an integral joint capable of carrying loads there between. Mechanical attachment methods, adhesive, co-curing of composite joint reinforcements, doublers, pinned connections, and bayonet-type joints are some of the possible methods of attachment. Fasteners may include ceramic pins or other devices made of high temperature-compatible material. When the core region 58 of an airfoil 44 is subsequently filled with a core material, the core material may serve as at least part of the joint structure.

Figure 4:
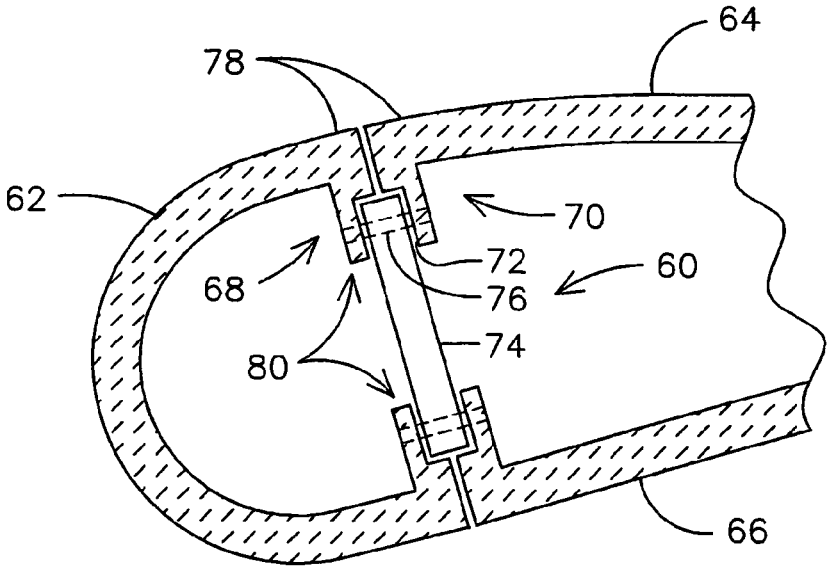
FIG. 4 is a cross-sectional view of a joint between three pre-fired open CMC structural panels.

FIG. 4 is a cross-sectional view of a joint 60 formed between three pre-fired structural CMC panels: a leading edge panel 62, a suction side panel 64 and a pressure side panel 66, such as may form a portion of an airfoil for a gas turbine engine. In this embodiment, the panels have respective flanged ends 68, 70 that when joined define an opening 72 for receiving a rib 74. The leading edge panel 62 has a C-shape with an open end that enables relative movement of the opposed ends 68 during firing prior to being joined to the adjacent members 64, 66. The suction side panel 64 and the pressure side panel 66 are also open shapes being nearly flat panels and having only a gently curved surface. These panels 64, 66 may also be pre-fired prior to being joined to the leading edge panel 62. The rib 74 may be metal, CMC material or other compatible material. Each end of the rib 74 and the respective mating flanged ends 68, 70 are joined together to form a load-bearing joint 80, such as with an adhesive, by being co-cured, and/or with a pin 76, for example. The pin 76 may be metal, CMC material or other compatible material. Rib 74 strengthens the resulting structure, for example improving the ability of the structure to withstand internal pressure created by a flow of cooling air. Rib 74 may extend along any desired length in a radial direction (perpendicular to the plane of FIG. 4). In a gas turbine embodiment, rib 74 may extend over only a limited radial distance in order to minimize the thermal stresses created by the temperature difference between the relatively hot exterior surfaces 78 and the relatively cool rib 74. In other embodiments, features similar to the rib 74 of FIG. 4 and the clamp 56 of FIG. 3 may be combined into a clamping arrangement that optimizes resistance to loads directed both along the chord length and perpendicular to the chord length.

Disclosed herein, therefore, is a method of forming a component containing structural CMC members, and particularly, structural CMC members containing curvilinear regions such as a leading or trailing edge of an airfoil, in a manner wherein interlaminar stresses generated by anisotropic shrinkage of the CMC material are relieved through the use of a plurality of open panels that are joined together to form the component only after at least a portion of the anisotropic shrinkage is achieved in an unconstrained state. This method overcomes a significant manufacturing barrier of prior art processes wherein geometrically constrained shapes were prone to interlaminar cracking due to anisotropic shrinkage of the CMC structural member. At least one panel member defining a portion of airfoil is formed in a wet state to have an open geometry, then processed to at least a partially cured state in a manner wherein surface-normal shrinkage resulting from anisotropic sintering shrinkage of the member is geometrically unrestrained, thereby relieving any resulting interlaminar stress. The panel member is then mechanically joined to an adjacent structural member of the airfoil to enable the members to carry structural loads there between. The adjacent structural member may be a similarly formed pre-shrunk open CMC structural member. A pre-load may be applied to the member as it is mechanically joined, with the amount of the displacement/preload being embodiment-specific. When two open CMC structural members are mechanically joined together, the amount of the preload-displacement applied to the two respective CMC members may be the same or may be different. Different displacements are achieved by properly selecting their relative unloaded geometries of the mating component parts. For example, the amount of displacement applied to the open ends of the leading edge panel 46 may be different than the amount of displacement applied to the open ends of the trailing edge panel 52 during final assembly of airfoil 44 of FIG. 3.

While various embodiments of the present invention have been shown and described herein, it will be obvious that such embodiments are provided by way of example only. Numerous variations, changes and substitutions may be made without departing from the invention herein. For example, the techniques disclosed herein may be applied to structures other than airfoils, for example, combustor transition pieces, combustor liners or ring segments for gas turbine engines. Accordingly, it is intended that the invention be limited only by the spirit and scope of the appended claims.

The invention claimed is:

1. A method of fabricating a load-bearing structure from structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member;

further comprising pre-loading the shrunk open member during the joining step.

2. A method of fabricating a load-bearing structure from structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member;

further comprising forming the open member to have a generally C-shape defining an airfoil leading edge;

joining the shrunk open member to an adjacent panel member comprising one of a suction side panel and a pressure side panel with a clamp formed of CMC material; and finish firing the shrunk open member and clamp together.

3. The method of claim 2, further comprising pre-loading the shrunk open member during the joining step.

4. A method of fabricating a load-bearing structure form structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member;

further comprising forming the open member to have a generally C-shape defining an airfoil leading edge;

forming a first joint between a first end of the shrunk open member, a suction side panel member, and a first end of a rib member; and forming a second joint between a second end of the shrunk open member, a pressure side panel member, and a second end of the rib member.

5. The method of claim 4, further comprising performing the steps of forming a first joint and forming a second joint concurrently while applying a pre-load to the generally C-shape open member.

6. A method of fabricating a load-bearing structure from structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member;

further comprising forming the open member to have a generally V-shape defining an airfoil trailing edge;

forming a first joint between a first end of the shrunk open member, a suction side panel member, and a first end of a rib member; and forming a second joint between a second end of the shrunk open member, a pressure side panel member, and a second end of the rib member.

7. The method of claim 6, further comprising performing the steps of forming a first joint and forming a second joint concurrently while applying a pre-load to the generally V-shape open member.

8. A method of fabricating a load-bearing structure from structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member;

wherein the open shape is formed to comprise an airfoil shape comprising a gap, and wherein the step of joining further comprises applying a backing member to close the gap.

9. The method of claim 8, further comprising applying a pre-load to the airfoil shape during the step of joining.

10. A method of fabricating a load-bearing structure from structural ceramic matrix composite (CMC) material, the method comprising:

forming at least one open member using a CMC material;

subjecting the open member to a process causing anisotropic shrinkage of the CMC material in a geometrically unconstrained state so that a first portion of the open member is free to move relative to a second portion of the open member to relieve interlaminar stresses resulting from the anisotropic shrinkage; and joining the shrunk open member to an adjacent structural member to form a closed member; and after forming the closed member, casting a ceramic core material in a core region of the closed member; and finish firing the closed member and the ceramic core material together.

11. An apparatus at a stage of manufacture comprising:

an open member formed of CMC material having been subjected to a process causing at least some anisotropic shrinkage of the CMC material, the shrunk open member comprising opposed ends separated by a gap during the process to relieve interlaminar stresses developed as a result of the anisotropic shrinkage; and a joining member subsequently attached between the opposed ends and imposing a preload on the member.

12. The apparatus of claim 11, wherein the open member comprises a generally C-shape defining a leading edge shape of an airfoil.

13. The apparatus of claim 11, wherein the open member comprises a generally V-shape defining a trailing edge shape of an airfoil.

14. The apparatus of claim 11, wherein the open member comprises a flanged end and wherein the joining member comprises a flanged end, and further comprising a clamp joining the respective flanged ends of the open member and the joining member.

* * * * *